United States Patent [19]

Gerger, Jr.

[11] Patent Number: 4,586,419

[45] Date of Patent: May 6, 1986

[54] DUPLEX VALVES AND METHODS FOR THEIR USE

[76] Inventor: Peter J. Gerger, Jr., 7640 Waters Rd., Cheltenham, Pa. 19012

[21] Appl. No.: 744,291

[22] Filed: Jun. 12, 1985

Related U.S. Application Data

[63] Continuation of Ser. No. 479,577, Mar. 28, 1983, abandoned.

[51] Int. Cl.[4] ..... G10B 3/10

[52] U.S. Cl. ..... 84/335; 84/338

[58] Field of Search ..... 84/330, 331, 333, 335, 84/338, 339–342, 347

[56] References Cited

U.S. PATENT DOCUMENTS

| | | | |
|---|---|---|---|
| 1,286,059 | 11/1918 | Morris . | |
| 1,974,530 | 9/1934 | Brown | 84/339 |
| 1,984,167 | 12/1934 | Wick | 84/335 |
| 1,986,956 | 1/1935 | Brown et al. | 84/339 |
| 2,089,332 | 8/1937 | Boner | 84/339 |
| 2,335,311 | 11/1943 | Reisner | 84/339 |
| 2,392,411 | 1/1946 | Reisner | 84/339 |
| 2,458,653 | 1/1949 | Seybold | 84/376 |
| 2,805,595 | 9/1957 | Gundling | 84/339 |
| 3,024,689 | 3/1962 | Miles et al. | 84/335 |

OTHER PUBLICATIONS

Art of Organ Building, Chapter XXVI, George Audsley.

*Primary Examiner*—L. T. Hix
*Assistant Examiner*—Douglas S. Lee
*Attorney, Agent, or Firm*—Woodcock Washburn Kurtz Mackiewicz & Norris

[57] ABSTRACT

Duplex pneumatic valves are provided for use in regulating the flow of air from a wind chest through an orifice to a pneumatic work chamber such as an organ pipe. The duplex valves comprise a principle valve having a rear surface and a seating surface seatable on the orifice and at least one venting channel in the principle valve means communicating with each of the seating and rear surfaces, thereof, and an initial valve having a seating surface seatable on the venting channel at the rear surface of the principle valve means. Methods for controlling the flow of air into, for example, an organ pipe are also disclosed employing the duplex pneumatic valves of this invention.

5 Claims, 4 Drawing Figures

DUPLEX VALVES AND METHODS FOR THEIR USE

This is a continuation of application Ser. No. 479,577, filed Mar. 28, 1983. (now abanded)

BACKGROUND OF THE INVENTION

This invention is directed to valves for employment in the control of the flow of air from an area having high pneumatic pressure through an orifice into an area having relatively low pneumatic pressure. Such valves are frequently used in connection with the construction and rehabilitation of pneumatic pipe organs and similar devices. Such valves may also be employed in connection with pneumatic devices other than musical instruments and may find employment in any pneumatic device wherein the flow of air is valved to a chamber wherein pneumatic work is performed.

Numerous devices have been proposed for use and have been used in connection with the control of the flow of air to pipe organs. A classic work on this subject, the *Art of Organ Building,* George Audsley, Dover, N.Y., 1905 and 1965 describes numerous arrangements for such valves. Pages 230 et. seq. of the Audsley work discuss devices known as relief pallets which are designed to relieve the effect of pneumatic pressure upon an operative valving device to facilitate the opening of an air control orifice for the passage of air into an organ pipe. Such devices are clumsy and are not well adapted to the employment of modern means of valve actuation such as electromagnetic actuation.

U.S. Pat. Nos. 1,286,059 Morris, 1,974,530-Brown, 2,335,311 Reisner, 2,392,411 Reisner, 2,458,653 Seybold, and 2,805,595 Gundling are directed to valves for controlling the flow of air to pipe organs. U.S. Pat. Nos. 1,986,956 Brown et al and 2,089,332 Boner are directed to electromagnetic pipe organ valve assemblies which employ angular displacement of the valve with respect to the air transit orifice in an attempt to overcome pneumatic forces associated with unseating of the valve. None of the foregoing patents or publications discloses or suggests the novel, duplex valves of the present invention.

OBJECTS OF THE INVENTION

It is a principal object of the present invention to provide pneumatic duplex valves for regulating the flow of air from an area having a relatively high pneumatic pressure through an orifice to an area having a relatively low pneumatic pressure.

It is another object of this invention to provide pneumatic valves which require lesser forces than heretofore for the unseating of such valves from the orifice.

A further object of the invention provides duplex valves having initial valve means and principal valve means which are so constructed as to allow the initial valve means to be opened with a relatively small force to break the pneumatic seal extant at the principal valve means whereby lesser overall unseating forces are required for opening of the duplex valve.

A further object of the invention is to provide pneumatic duplex valves which are operable through the activation of electromagnetic actuation means.

Methods for the control of the flow of air in a pneumatic apparatus is also a principal object of this invention.

Methods for such control of air flow are comprehended employing the valves of this invention.

Another object of the invention provides methods for the control of air flow in pneumatic devices, especially pipe organs, wherein lesser forces are needed for unseating of valves than heretofore.

Another object of the present invention is to provide duplex pipe organ valves and methods for their employment which are less noisy than previous valves.

Still another object is to provide duplex pneumatic valves which have an improved tendency to seat properly upon closure.

These and other objects will become apparent from the review of the present specification.

SUMMARY OF THE INVENTION

Figure 1:
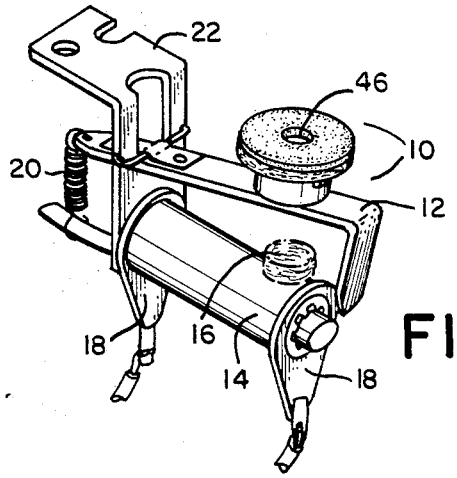
FIG. 1 is a perspective view of an electromagnetic valving apparatus employing a duplex valve in accordance with an embodiment of the present invention.

In the construction of new organs and in the refurbishment of older organs it is necessary to provide valving means between a source of compressed air and individual organ pipes. The actuation of the valves cause each organ pipe to "speak" in response to such actuation. In general, it is desired that such speech of an organ pipe be as responsive to the actuating stimulus as possible in order more closely to respond to the organist. Numerous organ valving schemes have been used in the past including mechanical, and electromechanical methods. A very popular method has been the use of electromagnetism to actuate an organ valve in response to an electronic signal transmitted from the organist to the valve assembly. As the electromagnet is actuated, a ferromagnetic material is caused to remove a valve seating surface from an orifice between a source of pressurized air, the wind chest, and an organ pipe. Numerous such electromagnetic-actuated pneumatic valves are disclosed in the prior art including those patents and publications disclosed hereinbefore. Present day electromagnetic-actuated pneumatic valves are represented, for example, by those offered for sale by the Reisner Company of Hagerstown, Md. These devices comprise a means for generally biasing a pivoted arm carrying a valve having a valve seating surface generally away from an adjacent electromagnetic means and into seating contact with pipe orifice. Upon activation of the electromagnetic means, the arm and attached valve are drawn towards the magnet and away from the orifice between wind chest and organ pipe.

The deactivation of the electromagnet allows the biasing means to return the arm and attached valve to the seating position to close the orifice and cause stoppage of air flow into the organ pipe.

While the foregoing electromagnetic valving apparatuses are suitable for use in pneumatic valving schemes wherein moderate pneumatic pressures are experienced and/or small diameter orifices are employed, such devices are far less suitable for use in those circumstances where large pneumatic pressures are incurred and/or where large diameter orifices are to be valved. In such cases, the forces necessary to unseat a valve from an orifice becomes large, generally proportional to the area of the orifice and to the differential air pressure. This is exemplified by a need to provide large magnetic fields in electromagnets in accordance with such electromagnet valve apparatus. Such large field demands require expensive magnets, large power supplies, and generally more complicated and expensive equipment. The increased complexity of the electromagnetic devices for use with such increased air pressures and with large orifices also results in noisy operation of the devices.

The foregoing effects are especially pronounced in older organs which are being refurbished. In such cases, it is frequently experienced that organ pipe registers are designed with relatively large air pressure demands, on the order of 5–10 inches of water or more. Such large pressures can not be conveniently diminished since the pipe registers have been voiced to respond to such high pressures. In such cases, it is desired to replace electropneumatically or mechanically activated valves, which are capable of overcoming the unseating forces necessary in such situations, with electromagnetic responsive valves. The present invention is directed to duplex valves which are capable of being employed in circumstances of high air pressure and large orifice diameter without expense of requiring large magnetic fields. Accordingly, increased costs due to increased complexity of the electromagnetic valve assembly is avoided. In addition to the foregoing, devices in accordance with this invention enjoy salutorious effects of the duplex valves in that they operate with less noise and exhibit more positive sealing or seating upon closure than do alternative valves assemblies.

Accordingly, this invention provides pneumatic duplex valves for regulating the flow of air from a wind chest having a pneumatic pressure through an orifice to a pneumatic work chamber such as an organ pipe. The duplex valves of this invention comprise a principal valve having a rear surface and a seating surface seatable on the orifice between wind chest and pipe, said principal valve has one or more venting channels communicating with each of the seating and rear surfaces. The duplex valve further comprises an initial valve having a seating surface which is seatable on the venting channel at the rear surface of the principal valve. In accordance with preferred embodiments, a duplex valve is employed in combination with electromagnetic activation means for unseating the valve and with biasing means for returning the valve to a seated position on termination of the electromagnetic or other activation.

Methods for activating pneumatic work chambers, especially organ pipes which are attached to a wind chest via an orifice, are also contemplated by the present invention. Thus, the initial valve is unseated from the venting channel in the principal valve allowing air from the wind chest to travel via the venting channel into the orifice and organ pipe space. This has the effect of diminishing the differences in pressure between the wind chest and the organ pipe or work chamber. The force needed to unseat the principal valve from the orifice is thus diminished allowing for such unseating to take place electromagnetically at low to moderate electromagnetic operating voltages. The initial venting is possible at relatively low electromagnetic or other operating forces due to the fact that the diameter of the vent channel is relatively small compared to the size of the orifice. The force thus required to unseat the initial valve from the vent is concomitantly small.

DETAILED DESCRIPTION OF THE INVENTION

The present invention is best described by reference to the drawings. FIG. 1 depicts a duplex valve in accordance with a preferred embodiment of this invention 10 ready for mounting in the wind chest of a pipe organ. The valve 10 is attached to a pivotally moveable arm 12 pivotally assembled adjacent to an electromagnet 14. The arm 12 is a ferromagnetic material such as steel and is assembled such that activation of the electromagnet 14 via lead 18 causes establishment of a force drawing arm 12 and attached valve 10 towards the magnet 14. Resilient means 16 are preferably provided to avoid noisy impact of arm 12 on magnet 14. Biasing means 20 such as a spring preferably biases arm 12 and valve 10 away from the magnet 14 and into a seating position on a pipe or chamber orifice. Any suitable mounting means 22 may be used for attaching the assembly at a pneumatic valving location such as in a wind chest to control the flow of air through an orifice into such a pneumatic work chamber.

Figure 2:
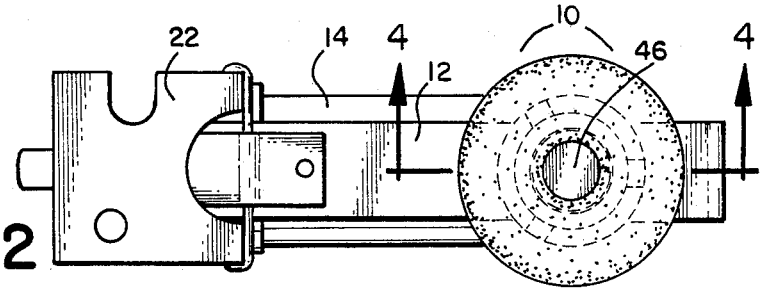
FIG. 2 depicts the apparatus of FIG. 1 in a top view suggesting the duplex nature of the valve and disclosing a venting channel transmitting the principal valve of the duplex.

FIG. 2 is a top view of the valve assembly of FIG. 1. Venting channel 46 together with a portion of the initial valve means, shown in phantom, are depicted.

Figure 3:
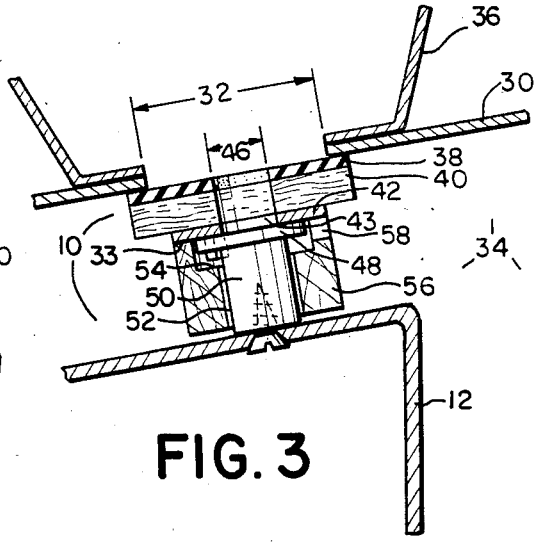
FIG. 3 is a cross-sectional view of the duplex valve in accordance with the preferred embodiment of the present invention. The valve is seated in place over an orifice between a wind chest and a pipe organ pipe.

FIG. 3 is a cross-sectional view of a closed duplex valve in accordance with a preferred embodiment of this invention. The valve 10 is mounted interior to a wind chest suggested by 34, such as at the top board thereof 30. A pneumatic work chamber such an organ pipe shown in partial 36 is located adjacent to wind chest 34 and is in communication therewith via orifice 32. The orifice, in this depiction, passes through top board 30 and pipe 36. Preparatory to activation, the work chamber or pipe 36, the valve 10 is closed to cover or seat on the orifice 32 and the wind chest 34 is given a pneumatic pressure higher than that of chamber 36; usually this is a positive pressure. In order to activate the work chamber or to cause the organ pipe to "speak", the valve 10 is unseated from orifice 32 allowing air to flow from wind chest 34 into the chamber or pipe 36. Subsequent reseating of valve 10 over orifice 32, such as through the biasing means 20 of FIG. 1, causes termination of air flow into the pipe or chamber 36 or termination of the pipe speech.

The duplex valve 10 comprises a principal valve means and an initial valve means. The principal valve means comprises a seating surface 38 adapted to cover and extend beyond orifice 32 in a substantially air-tight fashion thus to preclude air flow through said orifice. This covering is denominating "seating" on the orifice. The seating surface 38 may comprise leather, plastic, rubber or any other firmly resilient but pliable material suitable for effective seating as will be known to those skilled in the art. The seating surface 38 is preferably backed with one or more supporting means 40 and 42, which, in the illustrated embodiment, comprise felt and aluminum respectively. The principal valve means thus also has a rear surface 33 away from the seating surface 38. Although rear surface 33 and seating surface 38 may each comprise parts of a unitary article if desired. The principal valve means also comprises support means 56 attached to the rear surface 33. The support means 56 is preferably not directly fixed to arm 12. The support means 56 preferably has a passage 52 therein for containing the initial valve 48 as will be described. The passage means 52 communicates with the wind chest via one or more air hole means 58. At least one venting channel 46 is provided in the principal valve means, which channel 46 communicates with each of the principal valve seating surface 38 and rear surface 43. The vent channel 46 is situated so as also to communicate with orifice 32 when the valve is closed.

Figure 4:
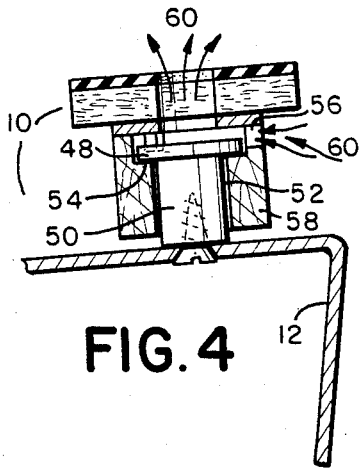
FIG. 4 depicts the valve of FIG. 3 wherein an initial valve means has been caused to unseat from a vent channel in the principal valve means to permit the transmitting of air from the wind chest to and through the orifice thus to diminish the pressure differential between wind chest and organ pipe. Continued application of force upon the duplex valve as disclosed in FIG. 4 will result in the full unseating and opening of the valve from the orifice.

The initial valve of the duplex valve of this invention is provided with a seating surface 48 seatable on the venting channel 46 at the rear surface 33 of the principal valve. The seating surface 48 of the initial valve preferably comprises a resilient, but deformable material such as leather, rubber or plastic, which forms a substantially air-tight seal upon seating on the vent channel 46. In accordance with a preferred embodiment, the seating surface 48 comprises a rigid inner portion such as fiber board covered with, for example, leather. The initial valve preferably also comprises a support means 50 affixed to seating surface 48. The support means 50 is likewise fastened to arm 12 in the depicted embodiment. The support means 50 and seating surface 48 are designed to fit within and move in passage 52. Thus, the initial valve may move between extremes defined by contact of the outer portion of the seating surface 43 with the rear surface 42 of the principal valve and contact of the rearward portion of seating surface 48 with interferring surface 54 of the passage 52 as shown in FIG. 4. As will be appreciated, exertion of force upon initial valve support 50 first causes unseating of the initial valve seating surface 48 from vent channel 46 as shown in FIG. 4. Force will then be transmitted to interfering surface 54, principal valve support means 56 and thence to principal valve seating surface 38 by contact of the rearward portion of initial valve seating 48 with interfering surface 54. This force will tend to unseat principal valve seating surface 38 from the orifice 32 and to allow air to flow from wind chest 34 to work chamber or organ pipe 36 as in FIG. 4. The foregoing action is nearly instantaneous and may be repeated at a rapid frequency. An opposite force acting upon arm 12 and initial valve support means 50 such as through employment of biasing means 20 of FIG. 1, will reverse this process and cause seating of principal valve seating surface 38 on the orifice 32 and of initial valve seating surface 48 onto vent channel 46. The duplex valve will, thus, return to the position of FIG. 3 following termination of the actuation of the valve.

As will be appreciated by those skilled in the art, the force needed to remove a valve covering from an orifice between an area of relatively high pneumatic pressure such as wind chest 34 and an area of relatively low pneumatic pressure such an organ pipe 36 is proportional both to the area of the orifice and to the pressure differential. Thus, unseating a valve covering a large orifice will require a large unseating force. In accordance with this invention, unseating of the principal valve seating surface 38 covering an orifice 32 is preceded by the unseating of an initial valve seating surface covering one or more vent channels 46 through the principal valve. The initial unseating serves to allow air from the wind chest to transit one or more of the hole 58, the passage 52, and vent channel 46 to diminish the pneumatic pressure differential between the wind chest 34 and chamber or pipe 36. This is suggested by 60 in FIG. 4. This diminished pressure differential allows a smaller unseating force to unseat the principal valve seating surface 38 from orifice 32. The unseating of the initial valve seating surface 48 from vent channel 46 occurs with a relatively small force due to the small area of vent 46. Thus, the overall force required to uncover orifice 32 at a given pressure differential is substantially reduced by employing a duplex valve in accordance with the present invention.

When electromagnets are employed to activate, for example, organ pipe valves, employment of the duplex valves of the present invention permits operation of the magnets at lower voltages with concomitant savings through use of inexpensive magnets and related equipment. At the same time, magnet noise is dimisnished.

The benefits of the present invention are most pronounced when employed in connection with the renovation of old pipe organs. Many organs, especially those with mechanical electropneumatic or tubular pneumatic rather than electromagnetic valve actuators, employ relatively high pneumatic pressures for at least certain of the pipe registers. Such pressures may range up to about 4–10 and especially 6–8 inches of water. Such pipe registers have been voiced to reflect the higher pressure; they would suffer in quality from employing lower pneumatic pressures. It is difficult to provide magnet-actuated valves which operate at reasonable current and are also easily adjustable for replacement in such pipes due to the high unseating forces needed for opening valves against such high pressures. This problem is exacerbated in pipes having large orifices. Employing duplex valves in accordance with the present invention allows the use of less powerful magnets without reducing operating pressures.

Additional benefits attend the use of this invention. Valves in accordance with the invention respond very promptly to electromagnetic actuation; organ pipes controlled therewith speak promptly to the organist's touch. Moreover, the duplex valves of the present invention, as depicted in accordance with the embodiments of the Figures, are less liable to "cock" or seat improperly upon deactivation of the electromagnet than are certain prior valves. Excellence of response is the effect of the foregoing.

While the discussion has been largely directed to electromagnetically activated duplex pneumatic valves, valves activated mechanically, servomechanically or otherwise are also contemplated hereby. It has been found, however, to be most convenient to employ the duplex valves of this invention in connection with electromagnetic devices including arm and mounting means which are commercially available. Thus, a duplex valve of nominal ¾" size has been installed with a Reisner magnet assembly denominated 601(Reisner, Inc., Hagerstown, Md.). This assembly corresponds to the embodiment of the Figures and has been demonstrated to give excellent results at only modest magnet currents at 8"(of water) pneumatic pressure.

For further example, two Reisner magnet and valve assemblies which are commercially available under the trade designation 601 and 601-1 were tested against 8" of pneumatic pressure over ⅝ inch nominal orifices. The assemblies were adjusted to maximum efficiency and found to require 12 and 10 volts of current respectively for operation. A duplex valve in accordance with the present invention was substituted for the valve of the Reisner 601 assembly and found to require only 7 volts of current without adjustment. After adjustment, the valve operated well at less than 6.3 volts. Lower voltages will likely be operative as well but have not yet been tried.

The foregoing discussion is intended as illustrative only and is not intended to be limiting.

What is claimed is:

1. A pneumatic duplex valve for regulating the flow of air from a wind chest having a pneumatic pressure through an orifice to a pneumatic work chamber, said wind chest having a pneumatic pressure higher than the work chamber, comprising a principle valve having a rear surface and a seating surface seatable on said orifice, at least one venting channel extending through said principle valve and communicating with said orifice, and an initial valve having a seating surface seatable on the venting channel at the rear surface of the principle valve.

2. The duplex valve of claim 1 further comprising biasing means for seating said principle valve seating surface on said orifice and said initial valve seating surface on said venting channel.

3. The duplex valve of claim 1 further comprising electromagnetic means for drawing the initial valve means away from the venting channel and, subsequently, for drawing the principle valve means away from the orifice.

4. The duplex valve of claim 1 wherein the principle and initial valve means are coaxially mounted with respect to each other.

5. The duplex valve of claim 1 adapted for regulating flow of air to an organ pipe.

* * * * *

UNITED STATES PATENT AND TRADEMARK OFFICE

CERTIFICATE OF CORRECTION

PATENT NO. : 4,586,419

DATED : May 6, 1986

INVENTOR(S) : Peter J. Gerger, Jr.

It is certified that error appears in the above-identified patent and that said Letters Patent is hereby corrected as shown below:

Column 1, line 6, please delete "abanded" and substitute therefor --abandoned--.

Column 4, line 24, please delete "lead" and substitute therefor --leads--.

Signed and Sealed this

*Second* Day of *September 1986*

[SEAL]

*Attest:*

DONALD J. QUIGG

*Attesting Officer*

*Commissioner of Patents and Trademarks*